US005405695A

United States Patent [19]

Akatsu et al.

[11] Patent Number: 5,405,695

[45] Date of Patent: Apr. 11, 1995

[54] POLY(PHENYLENE SULFIDE) FIBERS AND PRODUCTION PROCESS THEREOF

[75] Inventors: Masamichi Akatsu, Shimoinayoshi; Eisho Nakano, Ibaraki; Hiroyuki Endo, Shimoinayoshi; Keiji Sonoda, Tochigi, all of Japan

[73] Assignee: Kureha Kagaku Kogyo K.K., Tokyo, Japan

[21] Appl. No.: 963,361

[22] Filed: Oct. 20, 1992

Related U.S. Application Data

[62] Division of Ser. No. 671,334, Mar. 19, 1991, Pat. No. 5,178,813.

[30] Foreign Application Priority Data

Mar. 23, 1990 [JP] Japan ..... 2-72193

[51] Int. Cl.[6] ..... D02G 3/00

[52] U.S. Cl. ..... 428/364; 528/189; 528/388

[58] Field of Search ..... 428/364; 528/388, 189

[56] References Cited

U.S. PATENT DOCUMENTS

| | | | |
|---|---|---|---|
| 4,610,916 | 9/1986 | Ballard | 428/364 |
| 4,645,826 | 2/1987 | Iizuka et al. . | |
| 4,748,077 | 5/1988 | Skinner et al. | 428/364 |
| 4,801,492 | 1/1989 | Skinner et al. | 428/364 |
| 4,806,407 | 2/1989 | Skinner et al. | 428/364 |
| 4,976,908 | 12/1990 | Mizuno et al. . | |
| 5,013,823 | 5/1991 | Mizuno et al. | 528/338 |
| 5,162,151 | 11/1992 | Smith et al. | 428/364 |

FOREIGN PATENT DOCUMENTS

| | | |
|---|---|---|
| 0195422 | 9/1986 | European Pat. Off. . |
| 62-299513 | 12/1987 | Japan . |
| 64-3961 | 1/1989 | Japan . |
| 1-229809 | 9/1989 | Japan . |
| 1-239109 | 9/1989 | Japan . |

OTHER PUBLICATIONS

World Patents Index Latest Week 9014, Derwent Publications, Ltd., London, GB; AN 90-103290 & JP-A-2 053 913 (Toray Monofilament) 22, Feb. 1990 abstract.

World Patents Index Latest Week 8806, Derwent Publications, Ltd., London GB; AN 88040110 & JP-A-62 299 513 (Toray Monofilament) 26, Dec. 1987 abstract.

*Primary Examiner*—N. Edwards

*Attorney, Agent, or Firm*—Price, LeBlanc & Becker Lowe

[57] ABSTRACT

Disclosed herein are poly(phenylene sulfide) fibers having a tensile strength of at least 3.5 g/d, a knot tenacity of at least 2 g/d, a loop tenacity of at least 3.5 g/d, the number of abrasion cycles until breaking in a flexing abrasion test of at least 3,000 times, and the number of repeated flexings until breaking in a flexural fatigue test of at least 150 times. A process for the production of poly(phenylene sulfide) fibers, which comprises melt-spinning a poly(phenylene sulfide), stretching the resultant unstretched filaments at a draw ratio of 2:1 to 7:1 within a temperature range of 80°-260° C., and heat-treating the stretched filaments for 0.1-30 seconds under conditions of a take-up ratio of 0.8:1 to 1.35:1 in a dry heat atmosphere exceeding 285° C., but not exceeding 385° C. is also disclosed.

7 Claims, 1 Drawing Sheet

POLY(PHENYLENE SULFIDE) FIBERS AND PRODUCTION PROCESS THEREOF

This application is a division of application Ser. No. 07/671,334 filed Mar. 19, 1991, now U.S. Pat. No. 5,178,813.

FIELD OF THE INVENTION

The present invention relates to fibers of a poly(phenylene sulfide) (hereinafter may abbreviated as "PPS"), and more specifically to PPS fibers good in tensile strength, knot tenacity and loop tenacity and excellent in flexing abrasion resistance and flexing fatigue resistance, and a production process thereof.

BACKGROUND OF THE INVENTION

PPS fibers have excellent heat resistance, chemical resistance, flame retardance and the like and hence have been expected to permit their use in various application fields such as various kinds of filters, electrical insulating materials and fibers for paper machine canvases.

However, the PPS fibers are still insufficient in strength properties such as tensile strength and knot tenacity, or flex-resistant performance.

Various proposals have heretofore been made in order to improve the mechanical properties, heat resistance, chemical resistance and the like of the PPS fibers.

For example, it is disclosed in Japanese Patent Publication No. 3961/1989 to stretch unstretched PPS filaments at a draw ratio higher than a natural draw ratio as first-stage stretching, and then subject them to either a heat treatment at a temperature of 150°–260° C., which is higher than the stretching temperature in the first-stage stretching, under fixed length or second-stage stretching in the same temperature range to give a total draw ratio of 1–2 times that of the first-stage stretching, thereby improving the mechanical properties, heat resistance and chemical resistance of the filaments.

In Japanese Patent Application Laid-Open No. 299513/1987, there is disclosed a process for producing PPS monofilaments improved in tensile strength and knot tenacity by melt-extruding a linear PPS having a melt flow rate of 200 or lower, cooling the extrudate in hot water of at least 60° C., subsequently subjecting the thus-obtained unstretched monofilaments to first stretching at a draw ratio such that a ratio of the first draw ratio to a total draw ratio is lower than 0.88 and then to a multi-stage stretching to give the total draw ratio of 4:1, and then heat-treating them under relaxation in an air bath at 200°–280° C.

It is disclosed in Japanese Patent Application Laid-Open Nos. 229809/1989 and 239109/1989 to melt-spin PPS, stretch the resulting fibers at one stage using a heated member (hot roller), heat set the thus-stretched fibers using another heated member the surface temperature of which is 100°–140° C. and then further heat set the thus-treated fibers using a further heated member the surface temperature of which is in a range of from at least 150° C. to at most the melting point of the PPS, thereby obtaining PPS fibers extremely reduced in fuzzing, filament breaking and end breakage.

However, since the processes according to these known techniques have failed to improve the flex resistance to a sufficient extent, it has been unable to obtain PPS fibers excellent in tensile strength, knot tenacity and the like and moreover, sufficiently good in flex resistance. Accordingly, there has not been obtained under the actual circumstances any PPS fibers which can satisfactorily meet flexing abrasion resistance and flexing fatigue resistance required urgently for use, for example, as fibers for paper machine canvases.

OBJECTS AND SUMMARY OF THE INVENTION

It is an object of this invention to provide PPS fibers possessing good heat resistance, chemical resistance and flame retardance characteristic of a PPS to be used intact, having strength properties such as tensile strength, knot tenacity and loop tenacity, which are required for their processing and use, to a sufficiently high degree, and moreover having excellent flex resistance such as flexing abrasion resistance and flexing fatigue resistance.

The present inventors have carried out an extensive investigation with a view toward overcoming the above problems involved in the prior art. As a result, it has surprisingly been found that PPS fibers significantly improved in flexing abrasion resistance and flexing fatigue resistance and possessing strength properties such as tensile strength, knot tenacity and loop tenacity and performance such as heat resistance and chemical resistance to a sufficiently high degree can be obtained by melt-spinning a PPS, stretching the resultant fibers and then heat-treating the thus-stretching fibers under specific conditions in a dry heat atmosphere of such an elevated temperature as exceeds the melting point of the PPS.

The heat treatment in the dry heat atmosphere of such an elevated temperature as exceeds the melting point of the PPS may be conducted either right after the stretching or subsequent to an optional ordinary heat treatment, for example, a heat treatment at a temperature of at most 280° C.

Heat treatments in the prior art are all those in a temperature range of the melting point (near 280° C.) of the PPS or lower. The heat treatment under such temperature conditions as exceeds the melting point has not been carried out for reasons that end breakage occurs frequently, and so on. Besides, It has not been proposed to date to subject the stretched PPS fibers to the ordinary heat treatment (first heat treatment) at 280° C. or lower and subsequently conduct further the heat treatment (the second heat treatment) at such a high temperature as exceeds the melting point.

The reason why the flex resistance is improved significantly by the process according to the present invention is unapparent at this stage. It is however presumed that molecular orientation on the surfaces of the fibers is somewhat relaxed by subjecting the fibers to the heat treatment for a short period of time under relatively low tension in the dry heat atmosphere of such a high temperature as exceeds the melting point of the PPS, so that increase in degree of crystallinity on the fiber surfaces is prevented.

The present invention has been led to completion on the basis of this finding.

According to the present invention, there are thus provided poly(phenylene sulfide) fibers having the following physical properties:

tensile strength being at least 3.5 g/d;

knot tenacity being at least 2 g/d;

loop tenacity being at least 3.5 g/d;

number of abrasion cycles until breaking in a flexing abrasion test being at least 3,000 times; and number of repeated flexings until breaking in a flexural fatigue test being at least 150 times.

According to this invention, there is also provided a process for the production of poly(phenylene sulfide) fibers, which comprises the following steps 1 through 3:

Step 1: melt-spinning a poly(phenylene sulfide);

Step 2: stretching the unstretched filaments obtained in Step 1 at a draw ratio of 2:1 to 7:1 within a temperature range of 80°–260° C.; and Step 3: heat-treating the stretched filaments obtained in Step 2 for 0.1–30 seconds under conditions of a take-up ratio of 0.8:1 to 1.35:1 in a dry heat atmosphere exceeding 285° C., but not exceeding 385° C.

In an aspect of the present invention, the production process comprises melt-spinning the poly(phenylene sulfide), stretching the resulting unstretched filaments, optionally subjecting the thus-stretched filaments to an ordinary heat treatment (first heat treatment) at 280° C. or lower and then conducting further a heat treatment (second heat treatment) in a dry heat atmosphere exceeding 285° C., but not exceeding 385° C.

DETAILED DESCRIPTION OF THE INVENTION

Figure 1:
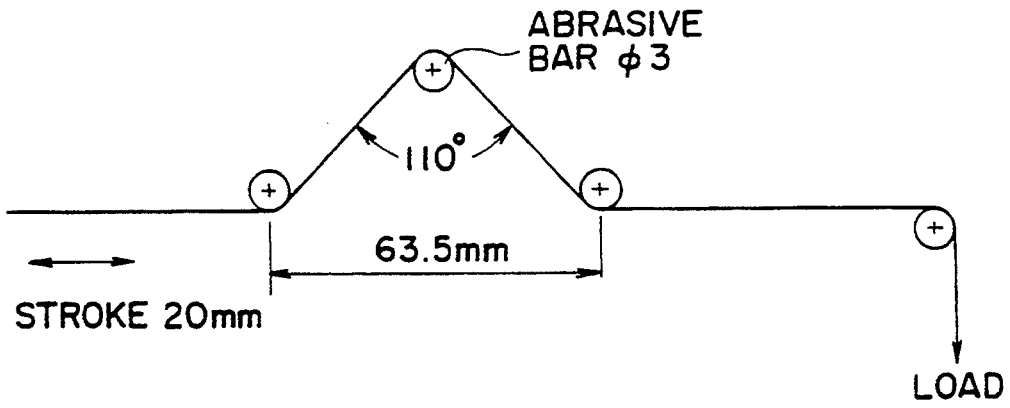
FIG. 1 illustrates a flexing abrasion tester used in the present invention and a measuring method making use of same.

Features of the present invention will hereinafter be described in detail.

Poly(phenylene sulfide):

The PPS useful in the practice of this invention means a polymer comprising phenylene sulfide units such as p-phenylene sulfide units and/or m-phenylene sulfide units.

The PPS may be a homopolymer of p-phenylene sulfide or m-phenylene sulfide or a copolymer having both p-phenylene sulfide units and m-phenylene sulfide units. Besides, the PPS may be a copolymer of a phenylene sulfide and any other aromatic sulfide or a mixture of a PPS and a polymer of the aromatic sulfide unless it departs from the spirit of the present invention. Of these PPSs, a substantially linear polymer comprising, as recurring units, p-phenylene sulfide units in a proportion of at least 50 wt. %, preferably, at least 70 wt. %, more preferably, at least 90 wt. % is preferred.

The PPS employed in the present invention is desirably a polymer having a melt viscosity of at least 500 poises, preferably, at least 800 poises as measured at 310° C. and a shear rate of 1,200 $sec^{-1}$.

The PPS used in the present invention is suitably obtained by, for example, the process described in U.S. Pat. No. 4,645,826, i.e., a polymerization process in which an alkali metal sulfide and a dihalogenated aromatic compound are polymerized in the presence of water in an organic amide solvent such as N-methylpyrrolidone in accordance with a particular two-stage heat-up polymerization process.

According to such a polymerization process, there can be obtained a substantially linear, high-molecular weight PPS. However, PPSs in which a partially branched and/or crosslinked structure has been introduced by adding a polyhalogenated aromatic compound having three or more halogen substituents in a small amount may suitably be used. In addition, a cured polymer may also be used. However, a polymer too high in degree of crosslinking is not preferred because the resultant fibers will become poor in orienting behavior of their crystals and hence can not bring out their own strength.

Production process of PPS fibers:

(Melt-spinning: Step 1)

In the process for the production of the PPS fibers according to the present invention, a PPS is first of all melt-spun. An ordinary melt-spinning process can be used to conduct such a melt spinning. Namely, the PPS is melted at a melting temperature of about 300°–350° C. in an extruder to extrude the melt through a nozzle. The thus-obtained extrudate was cooled in a medium such as water, glycerol or air in a temperature range of a glass transition temperature of the PPS and lower, preferably, of temperatures lower than the glass transition temperature by about 5°–80° C., more preferably, of temperatures lower than the glass transition temperature by 5°–40° C. The thus-obtained PPS filaments are taken up on a roll.

The take-up speed on the roll is generally 0.5–300 m/min, preferably, 2–50 m/min. If the take-up speed on the roll should be too fast, a difference in molecular orientation will arise between the surfaces and interiors of the resultant fibers, so that it will be impossible to uniformly stretch the filaments in a subsequent stretching step. On the contrary, any take-up speeds slower than the discharged rate of the PPS through the nozzle will result in filaments uneven in fineness.

PPS fibers (the unstretched filaments) obtained by the melt spinning generally have a diameter of from about 50 μm to about 3 mm. However, it is not necessary for the cross section of the filaments to be a circular form. They may be in a square or rectangular form, or may be flat filaments in the form of an oval.

(Stretching process: Step 2)

The unstretched filaments obtained by the melt spinning are then streteced at a draw ratio of 2:1 to 7:1. The stretching temperature generally ranges from a temperature near the glass transition temperature of the PPS to 260° C., specifically, from 80° C. to 260° C., preferably, from 85° C. to 260° C. When PPS fibers are crystallized by stretching and orienting, good strength, heat resistance, chemical resistance and the like can be imparted thereto.

No particular limitation is imposed on the stretching process for the unstretched PPS filaments. In usual, they are stretched at a draw ratio higher than a natural draw ratio between a feed roll and a pull roll. The stretching may be conducted by either one-stage stretching or multi-stage stretching of at least two steps. The total draw ratio of the unstretched filaments in the stretching process is generally 2:1 to 7:1, preferably, 3:1 to 6:1, more preferably, 4:1 to 6:1.

After the stretching, if necessary, the stretched filaments may be heat-treated either under fixed length or under relaxation at a temperature not higher than the melting point of the PPS, generally, not higher than 280° C. in order to facilitate their dimensional stability and crystallization. This first heat treatment can be performed by the method known per se in the art. No particular limitation is imposed on the conditions thereof. As an exemplary method, may be mentioned a method wherein the heat treatment is performed for 0.1–50 seconds under conditions of a take-up ratio of 0.8:1 to 1.5:1 in a dry heat atmosphere of 200°–280° C.

The first heat treatment may be conducted at once or if desired, in at least twice by changing the temperature conditions, take-up ratio, heat-treating time and/or the like.

(Heat-treating process: Step 3)

The greatest feature of the present invention is in that the stretched filaments obtained either through the above-described stretching process or by optionally performing the ordinary heat treatment subsequent to the stretching process are heat-treated under specific conditions at an elevated temperature.

Namely, the stretched filaments are heat-treated for 0.1–30 seconds under conditions of a take-up ratio of 0.8:1 to 1.35:1 in a dry heat atmosphere exceeding 285° C., but not exceeding 385° C.

Although the melting point of PPS varies within a narrow range depending upon its molecular weight, degree of crystallinity, degree of orientation and the like, it is generally about 280° C. The heat treatment according to the present invention is conducted in a short period of time under relatively low tension at such a high temperature as exceeds the melting point of the PPS. By this heat treatment, the molecular orientation on the surfaces of the PPS fibers (stretched filaments) is somewhat relaxed and hence increase in degree of crystallinity on the fiber surfaces is prevented, so that it is presumed that the flexing fatigue resistance and flexing abrasion resistance of the PPS fibers are enhanced to a significant extent. However, it is needless to say that the scope of the present invention is not limited by such a theory or presumption. It seems that any heat-treating temperatures not higher than 285° C. will make the effect relaxing the molecular orientation on the surfaces of the PPS fibers less. As a result, the crystallization is rather facilitated and hence, the flex resistance can not be enhanced. If the temperature should exceed 385° C. on the other hand, fusion-off of the resulting PPS fibers will tend to take place and moreover, the effect improving the flex resistance will not be exhibited. In the case where the unstretched filaments are sufficiently stretched and oriented, for example, by subjecting them to the multi-stage stretching of at least two steps or by heat-treating them at 280° C. or lower subsequent to the multi-stage stretching in the stretching process (Step 2), a preferred temperature of the heat treatment in Step 3 ranges from 290° to 380° C., more preferably, from 300° to 370° C., most preferably, from 310° to 360° C.

The term "heat treatment in a dry heat atmosphere" as used herein means a treatment in a heated air bath or a heated inert gas stream, for example, a nitrogen gas stream. The heat treatment may be performed in the presence of a sprayed moisture in a small amount. However, if the fibers should be treated by dipping them into a high-temperature liquid medium or bringing them into contact with a heated member under such high-temperature conditions, fusing-off of the fibers will tend to occur and moreover, it will be impossible to bring about the effect uniformly relaxing the molecular orientation of the fiber surfaces only.

The take-up ratio (or feed ratio) of the PPS fibers is generally expressed in terms of a speed ratio of the take-up roll to the feed roll. In the heat treatment according to the present invention, the take-up ratio is controlled to 0.8:1 to 1.35:1. The heat treatments in which the take-up ratios are about 1:1, lower than 1:1 and higher than 1:1 are called "heat treatment under fixed length", "heat treatment under relaxation" and "heat treatment under stretching", respectively. Accordingly, when the heat treatment is performed at a take-up ratio exceeding 1:1 but not exceeding 1.35:1, stretching is also effected at the same time as the heat treatment.

Any take-up ratios lower than 0.8:1 will result in fibers in which the relaxation of the molecular orientation reaches their interiors by the heat treatment in the above-described temperature range, so that their strength will become insufficient and/or fusing-off of the fibers will occur during the heat treatment. On the contrary, any take-up ratios exceeding 1.35:1 will bring on deterioration of the knot tenacity and loop tenacity and also, lower the flexing abrasion resistance and flexing fatigue resistance. In addition, if the take-up ratio should be too high, fiber breakage will tend to take place. When the unstretched filaments are sufficiently stretched and oriented, for example, by subjecting them to the multi-stage stretching of at least two steps or by heat-treating them at 280° C. or lower subsequent to the multi-stage stretching in the stretching process (Step 2), the take-up ratio is preferably controlled in a range of from 0.8:1 to 1.2:1, more preferably, from 0.85:1 to 1.1:1.

The heat-treating time (residence time in the atmosphere) is 0.1–30 seconds, preferably 0.5–20 seconds, more preferably 1–15 seconds. Any time shorter than 0.1 second will fail to bring about the effect of the heat treatment according to this invention. On the contrary, any time longer than 30 second will tend to induce deterioration in strength and fusing-off of filaments.

The above-described heat-treating conditions in Step 3 are such that no fusing-off of the fibers occurs during the heat treatment, and orientation and crystallization of the fibers are scarcely facilitated as a whole.

In order to impart excellent strength, heat resistance, chemical resistance and the like to PPS unstretched filaments, they are generally subjected to multi-stage stretching of at least two steps, or are heat-treated at 280° C. or lower subsequent to the multi-stage stretching. According to the production process of this invention, however, PPS fibers excellent in strength and flex resistance can be obtained even if filaments are merely subjected to single-stage stretching and hence their stretching and orientation are insufficient.

Namely, even when unstretched PPS filaments are stretched 2–7 times at one stage and the thus-stretched filaments are then subjected to the heat treatment (Step 3) in a dry heat atmosphere exceeding 285° C. without performing the heat treatment at 280° C. or lower, PPS fibers having excellent physical properties can be obtained. In this case, it is preferable to perform the heat treatment under stretching in Step 3. More specifically, the stretched filaments are preferably heat-treated for 0.1–20 seconds under conditions of a take-up ratio of 1.15:1 to 1.35:1 in a dry heat atmosphere exceeding 285° C., but not exceeding 330° C. According to this process, fibers having excellent mechanical properties and flex resistance can be provided even when the stretching is performed at a total of two stages, one the one-stage stretching in Step 2 and the other the heat treatment under stretching in Step 3. In this case, the heat treatment may be effected in a dry heat atmosphere exceeding 330° C. It is however preferable to control such a temperature to at most 330° C. in order to obtain PPS fibers having stable physical properties. The residence time in the dry heat atmosphere is most preferably 0.3–10 seconds. When the diameter of the stretched filaments produced in Step 2 is relatively thick, a good effect can be attained even if the residence time in Step 3 is long. When the diameter is relatively thin on the other hand, it is preferred that the residence time is not very long in order to attain a good effect. Besides, the draw ratio in the one-stage stretching is preferably 3:1 to 6:1. Needless to say, it is also effective that filaments which have been subjected to, for example, second-stage stretching at a low draw ratio, or an ordinary heat treatment either at a low temperature or for a short period of time, in addition to the literal one-stage stretching, in the stretching process (Step 2) prior to the heat treatment under stretching (Step 3), are subjected to the heat treatment (Step 3) under the above-described conditions so long as their stretching and orientation are insufficient.

PPS fibers:

PPS fibers obtained in accordance with the process of the present invention are novel fibers having the following physical properties.

(1) Tensile strength is at least 3.5 g/d, preferably, at least 4.0 g/d;

(2) Knot tenacity is at least 2 g/d, preferably, at least 2.5 g/d;

(3) Loop tenacity is at least 3.5 g/d, preferably, at least 4.0 g/d;

(4) Flexing abrasion resistance in terms of the number of abrasion cycles until breaking in a flexing abrasion test is at least 3,000 times, preferably, at least 3,500 times; and (5) Flexing fatigue resistance in terms of the number of repeated flexings until breaking in a flexural fatigue test is at least 150 times.

The PPS fibers according to this invention also have good heat resistance and chemical resistance.

ADVANTAGES OF THE INVENTION

According to the present invention, there can be provided PPS fibers good in heat resistance and chemical resistance, excellent in strength properties such as tensile strength, knot tenacity and loop tenacity, and decidedly superior in flexing abrasion resistance and flexing fatigue resistance.

The PPS fibers according to this invention can be used in a wide variety of application fields, for example, as various kinds of filters, electrical insulating materials, etc. Of these, they are particularly suitable for use as fibers for paper machine canvases.

EMBODIMENTS OF THE INVENTION

The present invention will hereinafter be described specifically by the following Examples and Comparative Examples.

Incidentally, the measurements of the physical properties in the present invention were conducted by the following methods.

<Measurement Conditions of Physical Properties>

(1) Tensile strength, knot tenacity and loop tenacity:

Their measurement was conducted under conditions of a sample length of 200 mm and a cross-head speed of 200 mm/min in accordance with JIS L-1013. More specifically, the conditions described in JIS L-1013, 7.5.1 were followed to pull a sample at a grip interval of 20 cm (i.e., a sample length of 200 mm) and an extension speed of 100% of grip interval per minute (i.e., a cross-head speed of 200 mm/min) by means of a testing machine of the definite speed extension type, thereby measuring the load at the time the sample was broken. The tensile strength was calculated on the basis of this measurement value. The knot tenacity was determined in accordance with JIS L-1013, 7.6.1 under the similar conditions to the above 7.5.1. Namely, a knot was made at the middle of grips of a sample to measure the strength at breaking, thereby finding the average value. The loop tenacity was determined in accordance with JIS L-1013, 7.7.1 under the similar conditions to the above 7.5.1. Namely, a loop was made at the middle of grips of a sample to measure the strength at breaking, thereby finding the average value. Incidentally, the values as to the knot tenacity and loop tenacity are those obtained by converting measured values into the denier unit of each fiber sample.

(2) Flexing abrasion resistance:

JIS L-1095 was followed. Using a flexing abrasion tester of a system as illustrated in FIG. 1, wherein an abrading member is fixed and a filament sample is reciprocally moved, the number of abrasion cycles until breaking was measured at room temperature under conditions of a load of 0.2 g/d and a cycle of 105 times/min. Incidentally, 10 filaments of the same fiber sample were separately subjected to the flexing abrasion test to calculate the average value of their numbers of abrasion cycles until breaking.

Figure 2:
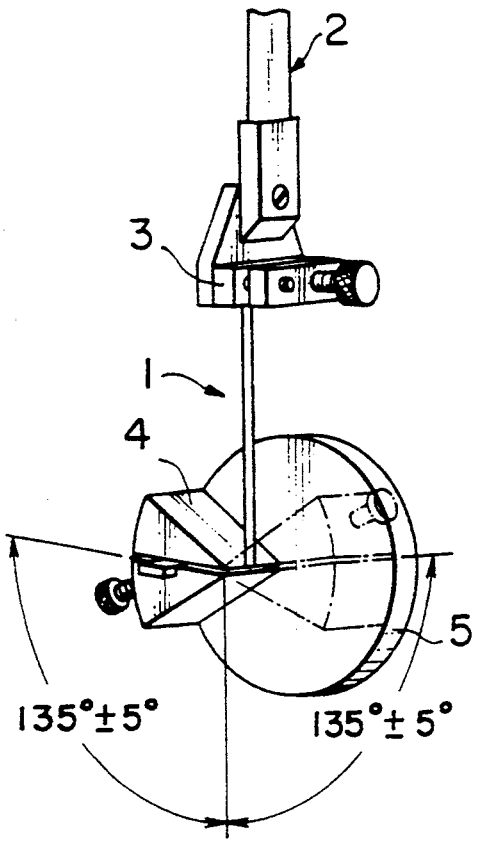
FIG. 2 illustrates a flexural fatigue tester used in the present invention.
Figure 3:
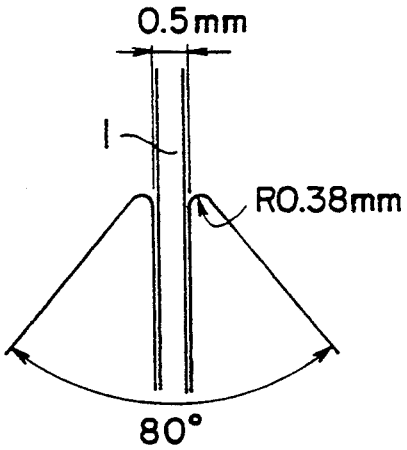
FIG. 3 illustrates a tip of a bending top in the flexural fatigue tester shown in FIG. 2.

(3) Flexing fatigue resistance:

JIS P-8115 was followed. Using a flexing fatigue tester ("MIT Crease-Flex Fatigue Resistance Tester" manufactured by Toyo Seiki Seisaku-Sho, Ltd.) shown in FIG. 2, the number of flexings until breaking was measured at room temperature under conditions of a load of 0.25 g/d, a swing cycle of 175 times/min and a swing angle of 270°.

Both ends of a sample (filament) 1 are fixed to an upper chuck (loading grip) 3 provided on a tip of a plunger 2 and a bending top (bending device) 4, respectively. A load corresponding to a tension required for the sample is applied to the plunger 2 to stop the plunger 2 at the position thereof. The bending top 4 is attached on to an attachment surface of a swinging chuck 5. The bending top 4 is caused to swing by a power-driven mechanism (not illustrated), thereby bending the sample at an angle of each 135°±5° (swing angle: 270°) from side to side. The bending top 4 has two bending surfaces each of which has a radius of curvature R of 0.38 mm±0.03 mm.

Ten filaments of the same fiber sample were separately subjected to the flexing fatigue test to calculate the average value of their numbers of repeated flexings until breaking.

(4) Heat resistance:

After leaving each PPS fiber sample to stand for 50 hours under relaxation in air of 250° C., the retention of tensile strength (%) was investigated.

(5) Chemical resistance:

After immersing each PPS fiber sample in 98% sulfuric acid for 100 hours at room temperature, the retention of tensile strength (%) was investigated.

EXAMPLE 1 & COMPARATIVE EXAMPLE 1

Using three kinds of poly(phenylene sulfides) (products of Kureha Chemical Industry Co., Ltd.) having melt viscosities (at 310° C. and a shear rate of 1,200 $sec^{-1}$) of 5,060 poises, 3,280 poises and 1,090 poises respectively, each of them was melt-extruded in a fibrous form through a nozzle having a bore diameter of 2.8 mm by an extruder having a cylinder bore of 25 mm (L/D=22) at an extrusion temperature of 300° C., followed by cooling with hot water of 85° C.

The unstretched filament samples thus obtained were respectively stretched 3.5 times as first-stage stretching in a wet heat atmosphere of 90° C. The thus-stretched filament samples were stretched 1.3 times as second-stage stretching in a dry heat atmosphere of 150° C., and then heat-treated under relaxation at a take-up ratio of 0.98:1 for 5.6 seconds in a dry heat atmosphere of 230° C. (the first heat treatment).

Then, portions of the filament samples thus treated were separately subjected to the second heat treatment in a heated air bath under their corresponding conditions shown in Table 1, thereby obtaining respective PPS fiber samples (monofilaments) having a diameter of about 450 μm. The conditions of the second heat treatment and the physical properties of the resultant monofilament samples are shown collectively in Table 1.

flexing abrasion resistance and flexing fatigue resistance. On the contrary, when the second heat treatment was conducted at a lower take-up ratio (Comparative Example 1, 1-6), the effect improving flexing abrasion resistance and flexing fatigue resistance became less and moreover, the tensile strength, knot tenacity and loop tenacity were lowered and the heat resistance and chemical resistance were also decreased.

When the temperature of the second heat treatment was too high (Comparative Example 1, 1-5), the fibers fused off during the heat treatment. On the other hand, the temperature too low (Comparative Example 1, 1-7) had no effect on the improvement of the flexing abrasion resistance and flexing fatigue resistance.

Incidentally, the degrees of crystallinity of the fiber samples were all 30%±5%. Therefore, any extraordinary increases in degree of crystallinity were not recognized.

TABLE 1

| | Example 1 | | | | | Comparative Example 1 | | | | | | |
|---|---|---|---|---|---|---|---|---|---|---|---|---|
| | 1-1 | 1-2 | 1-3 | 1-4 | 1-5 | 1-1 | 1-2 | 1-3 | 1-4 | 1-5 | 1-6 | 1-7 |
| Melt viscosity (poise) | 5,060 | 5,060 | 5,060 | 3,280 | 1,090 | 5,060 | 3,280 | 1,090 | 5,060 | 5,060 | 5,060 | 5,060 |
| Second heat-treating conditions: | | | | | | | | | | | | |
| Take-up ratio | 0.95:1 | 1.0:1 | 1.1:1 | 0.95:1 | 0.95:1 | — | — | — | 1.4:1 | 1.0:1 | 0.7:1 | 0.95:1 |
| Heat-treating temp (°C.) | 340 | 340 | 350 | 320 | 310 | — | — | — | 320 | 420 | 350 | 250 |
| Residence time (sec) | 3.3 | 4.0 | 2.5 | 3.0 | 5.4 | — | — | — | 3.0 | 3.0 | 2.5 | 8.5 |
| Physical properties: | | | | | | | | | | | | |
| Tensile strength (g/d) | 4.3 | 4.5 | 4.4 | 4.6 | 4.5 | 4.5 | 4.7 | 4.6 | 5.2 | | 3.9 | 4.4 |
| Tensile elongation (%) | 26 | 29 | 27 | 25 | 28 | 30 | 28 | 29 | 25 | | 33 | 31 |
| Knot tenacity (g/d) | 3.4 | 3.5 | 3.4 | 3.2 | 3.2 | 3.2 | 3.3 | 3.4 | 2.3 | | 2.6 | 3.3 |
| Knot elongation (%) | 19 | 17 | 16 | 15 | 17 | 23 | 21 | 20 | 16 | | 27 | 24 |
| Loop tenacity (g/d) | 4.9 | 4.7 | 5.0 | 4.7 | 4.8 | 4.9 | 4.8 | 4.8 | 4.1 | *1 | 3.8 | 4.7 |
| Loop elongation (%) | 12 | 11 | 11 | 13 | 13 | 17 | 19 | 18 | 18 | | 22 | 19 |
| Flexing abrasion resistance (times) | 4,527 | 3,677 | 4,198 | 4,081 | 3,824 | 1,510 | 1,320 | 1,213 | 1,126 | | 1,833 | 1,338 |
| Flexing fatigue resistance (times) | 178 | 160 | 165 | 155 | 154 | 100 | 92 | 87 | 91 | | 121 | 89 |
| Heat resistance (%) | 86 | 88 | 87 | 85 | 86 | 87 | 89 | 88 | 87 | | 81 | 87 |
| Chemical resistance (%) | 64 | 69 | 68 | 62 | 65 | 67 | 67 | 64 | 68 | | 53 | 66 |

*1: Fused off during the second heat treatment.

As is apparent from Table 1, the PPS fiber samples (Example 1, 1—1 through 1-5) obtained in accordance with the process of the present invention were all excellent in flex resistance, as demonstrated by the flexing abrasion resistance of at least 3,500 times and the flexing fatigue resistance of at least 150 times, and moreover good in strength properties such as tensile strength, knot tenacity and loop tenacity, heat resistance, and chemical resistance.

On the contrary, the PPS fiber samples (Comparative Example 1, 1—1 through 1-3) obtained by conducting only the heat treatment in the dry heat atmosphere of 230° C. were insufficient in flex resistance as demonstrated by the flexing abrasion resistance of 1,200–1,500 times and the flexing fatigue resistance of 90–100 times.

It is apparent from the above comparison as to the physical properties that the heat treatment under the conditions according to the present invention has a marvelous effect on the improvement of the physical properties.

Besides, the fiber sample (Comparative Example 1, 1-4) subjected to the second heat treatment at a higher take-up ratio was reduced in knot tenacity and also in

EXAMPLE 2 & COMPARATIVE EXAMPLE 2

A poly(phenylene sulfide) (product of Kureha Chemical Industry Co., Ltd. ) having a melt viscosity (at 310° C. and a shear rate of 1,200 $sec^{-1}$) of 5,060 poises was melt-extruded through a nozzle having a bore diameter of 2.8 mm by an extruder having a cylinder bore of 25 mm (L/D=22) at an extrusion temperature of 300° C., followed by cooling with hot water of 85° C.

The unstretched filament sample thus obtained was stretched 3.6 times as first-stage stretching in a wet heat atmosphere of 90° C. The thus-stretched filament sample was stretched 1.3 times as second-stage stretching in a dry heat atmosphere of 150° C., and then heat-treated under fixed length for 5.2 seconds in a dry heat atmosphere of 250° C. (the first heat treatment).

Thereafter, portions of the filament sample thus treated were respectively subjected to the second heat treatment in a heated air bath under their corresponding conditions shown in Table 2, thereby obtaining respective PPS fiber samples having a diameter of about 450 μm.

Results are shown in Table 2.

TABLE 2

| | Example 2 | | | | Comparative Example 2 | | | | | |
|---|---|---|---|---|---|---|---|---|---|---|
| | 2-1 | 2-2 | 2-3 | 2-4 | 2-1 | 2-2 | 2-3 | 2-4 | 2-5 | 2-6 |
| Melt viscosity (poise) | 5,060 | 5,060 | 5,060 | 5,060 | 5,060 | 5,060 | 5,060 | 5,060 | 5,060 | 5,060 |

TABLE 2-continued

| | Example 2 | | | | Comparative Example 2 | | | | | |
|---|---|---|---|---|---|---|---|---|---|---|
| | 2-1 | 2-2 | 2-3 | 2-4 | 2-1 | 2-2 | 2-3 | 2-4 | 2-5 | 2-6 |
| Second heat-treating conditions: | | | | | | | | | | |
| Take-up ratio | 0.85:1 | 0.90:1 | 1.0:1 | 1.1:1 | — | 0.7:1 | 0.9:1 | 0.9:1 | 0.9:1 | 1.5:1 |
| Heat-treating temp (°C.) | 320 | 340 | 340 | 360 | — | 300 | 340 | 260 | 420 | 320 |
| Residence time (sec) | 4.0 | 3.5 | 3.2 | 2.8 | — | 3.0 | 40 | 20 | 1.7 | 3.5 |
| Physical properties: | | | | | | | | | | |
| Tensile strength (g/d) | 4.1 | 4.3 | 4.5 | 4.6 | 4.4 | 3.6 | | 3.3 | 4.2 | |
| Tensile elongation (%) | 30 | 28 | 25 | 24 | 32 | 23 | | 19 | 27 | |
| Knot tenacity (g/d) | 3.0 | 3.3 | 3.1 | 2.8 | 3.3 | 2.1 | | 1.7 | 3.0 | |
| Knot elongation (%) | 18 | 16 | 15 | 13 | 20 | 12 | | 8 | 19 | |
| Loop tenacity (g/d) | 4.8 | 4.6 | 4.4 | 4.2 | 5.2 | 3.3 | *1 | 2.1 | 3.6 | *2 |
| Loop elongation (%) | 13 | 13 | 12 | 12 | 16 | 11 | | 7 | 10 | |
| Flexing abrasion resistance (times) | 4,870 | 4,486 | 4,023 | 3,645 | 1,856 | 1,472 | | 1,061 | 1,972 | |
| Flexing fatigue resistance (times) | 183 | 164 | 157 | 155 | 92 | 64 | | 54 | 55 | |
| Heat resistance (%) | 84 | 86 | 87 | 87 | 86 | 88 | | 86 | 88 | |
| Chemical resistance (%) | 62 | 65 | 66 | 65 | 65 | 67 | | 66 | 65 | |

*1: Fused off during the second heat treatment.
*2: Broke during the second heat treatment.

As is apparent from Table 2, all the PPS fiber samples obtained in accordance with the process of the present invention were high-performance fibers excellent in flex resistance, as demonstrated by the flexing abrasion resistance of at least 3,500 times and the flexing fatigue resistance of at least 150 times and moreover, good in strength properties such as tensile strength, knot tenacity and loop tenacity, heat resistance, and chemical resistance. On the contrary, the PPS fiber sample (Comparative Example 2, 2-1) obtained by conducting only the heat treatment in the dry heat atmosphere of 250° C. was insufficient in flex resistance as demonstrated by the flexing abrasion resistance of 1,856 times and the flexing fatigue resistance of 92 times.

Besides, when the second heat treatment was conducted at a lower take-up ratio (Comparative Example 2, 2-2), the flexing abrasion resistance and flexing fatigue resistance could not be improved and the strength properties were also reduced in general, with the loop tenacity being particularly deteriorated to a great extent. When the heat-treating time (residence time in the atmosphere) was too long (Comparative Example 2, 2-3), the filaments fused off during the heat treatment. When the heat-treating temperature was too low (Comparative Example 2, 2-4), the strength properties were reduced in general, and the flexing abrasion resistance and flexing fatigue resistance were also decreased. On the other hand, the temperature too high (Comparative Example 2, 2-5) scarcely had a property-improving effect even when the residence time was short. Increasing residence time at a higher heat-treating temperature will result in fusing-off of the filaments. The take-up ratio too high (Comparative Example 2, 2-6) resulted in filament breaking during the heat treatment.

EXAMPLE 3 & COMPARATIVE EXAMPLE 3

A poly(phenylene sulfide) (product of Kureha Chemical Industry Co., Ltd.) having a melt viscosity (at 310° C. and a shear rate of 1,200 $sec^{-1}$) of 5,060 poises was melt-extruded through a nozzle having a bore diameter of 2.8 mm by an extruder having a cylinder bore of 25 mm (L/D=22) at an extrusion temperature of 320° C., followed by cooling with hot water of 85° C.

The unstretched filament sample thus obtained was stretched 4.2 times as first-stage stretching in a wet heat atmosphere of 96° C. The thus-stretched filament sample was stretched 1.15 times as second-stage stretching in a dry heat atmosphere of 180° C., and then heat-treated under fixed length for 5.2 seconds in a dry heat atmosphere of 270° C. (the first heat treatment).

Thereafter, portions of the filament sample thus treated were respectively subjected to the second heat treatment in a heated air bath under their corresponding conditions shown in Table 3, thereby obtaining respective PPS fiber samples having a diameter of about 450 μm.

Results are shown in Table 3.

TABLE 3

| | Example 3 | | | Comparative Example 3 | | | |
|---|---|---|---|---|---|---|---|
| | 3-1 | 3-2 | 3-3 | 3-1 | 3-2 | 3-3 | 3-4 |
| Melt viscosity (poise) | 5,060 | 5,060 | 5,060 | 5,060 | 5,060 | 5,060 | 5,060 |
| Second heat-treating conditions: | | | | | | | |
| Take-up ratio | 0.92:1 | 0.96:1 | 0.96:1 | — | 0.75:1 | 0.96:1 | 1.4:1 |
| Heat-treating temp (°C.) | 340 | 340 | 360 | — | 340 | 390 | 340 |
| Residence time (sec) | 3.3 | 3.5 | 2.8 | — | 3.3 | 1.0 | 3.5 |
| Physical properties: | | | | | | | |
| Tensile strength (g/d) | 4.4 | 4.6 | 4.5 | 4.8 | | 4.6 | 5.1 |
| Tensile elongation (%) | 25 | 23 | 23 | 22 | | 21 | 17 |
| Knot tenacity (g/d) | 3.2 | 3.0 | 2.8 | 3.0 | | 2.7 | 2.1 |
| Knot elongation (%) | 18 | 16 | 17 | 16 | | 13 | 10 |
| Loop tenacity (g/d) | 4.5 | 4.3 | 4.4 | 4.2 | *1 | 3.9 | 2.3 |
| Loop elongation (%) | 15 | 13 | 14 | 13 | | 12 | 7 |
| Flexing abrasion resistance (times) | 4,122 | 3,563 | 3,719 | 1,156 | | 1,087 | 834 |
| Flexing fatigue | 169 | 159 | 163 | 82 | | 78 | 56 |

TABLE 3-continued

| | Example 3 | | | Comparative Example 3 | | | |
|---|---|---|---|---|---|---|---|
| | 3-1 | 3-2 | 3-3 | 3-1 | 3-2 | 3-3 | 3-4 |
| resistance (times) | | | | | | | |
| Heat resistance (%) | 87 | 88 | 86 | 88 | | 87 | 88 |
| Chemical resistance (%) | 69 | 69 | 67 | 68 | | 67 | 69 |

*1: The second heat treatment was infeasible due to filament looseness.

As is apparent from Table 3, the PPS fiber sample (Comparative Example 3, 3-1) obtained by conducting only the heat treatment in the dry heat atmosphere of 270° C. had a flexing abrasion resistance of 1,156 times and a flexing fatigue resistance of 82 times. On the contrary, the PPS fiber samples (Example 3, 3-1 through 3-3) obtained by subjecting such a fiber sample to the second heat treatment under the conditions according to the present invention were all high-performance fibers good in strength properties and moreover, excellent in flex resistance, as demonstrated by the flexing abrasion resistance of 3,500–4,100 times and the flexing fatigue resistance of 160–170 times.

Besides, when the second heat treatment was conducted at a lower take-up ratio (Comparative Example 3, 3-2), the filaments became loose in a heat-treating bath during the heat treatment, resulting in a failure in treatment. On the contrary, the take-up ratio too high (Comparative Example 3, 3-4) resulted in fibers too low in loop tenacity and reduced in flexing abrasion resistance and flexing fatigue resistance. The heat-treating temperature too high (Comparative Example 3, 3-3) scarcely had a property-improving effect.

EXAMPLE 4 & COMPARATIVE EXAMPLE 4

A poly(phenylene sulfide) (product of Kureha Chemical Industry Co., Ltd.) having a melt viscosity (at 310° C. and a shear rate of 1,200 $sec^{-1}$) of 5,060 poises was melt-extruded through a profile nozzle having an orifice of 1.75 mm long and 3.5 mm wide by an extruder having a cylinder bore of 25 mm (L/D=22) at an extrusion temperature of 320° C., followed by cooling with hot water of 85° C.

The unstretched filament sample thus obtained was stretched 4.2 times as first-stage stretching in a wet heat atmosphere of 96° C. The thus-stretched filament sample was stretched 1.15 times as second-stage stretching in a dry heat atmosphere of 180° C., and then heat-treated under fixed length for 5.0 seconds in a dry heat atmosphere of 270° C. (the first heat treatment).

Thereafter, the filament sample thus treated was subjected to the second heat treatment at a take-up ratio of 0.92:1 and in a residence time of 3.3 seconds in a dry heat atmosphere of 340° C., thereby obtaining flat PPS fiber sample of about 280 μm long and about 560 μm wide.

The PPS fiber sample thus obtained had the following physical properties and hence was excellent in strength properties and flex resistance:
tensile strength: 4.3 g/d;
tensile elongation: 24%;
knot tenacity: 3.1 g/d;
knot elongation: 17%;
loop tenacity: 4.4 g/d;
loop elongation: 14%;
flexing abrasion resistance: 4,018 times;
flexing fatigue resistance: 165 times;
heat resistance: 88%; and
chemical resistance: 70%.

EXAMPLE 5 & COMPARATIVE EXAMPLE 5

Using three kinds of poly(phenylene sulfides) (products of Kureha Chemical Industry Co., Ltd.) having melt viscosities (at 310° C. and a shear rate of 1,200 $sec^{-1}$) of 5,060 poises, 3,280 poises and 1,090 poises respectively, each of them was melt-extruded in a fibrous form through a nozzle having a bore diameter of 2.8 mm by an extruder having a cylinder bore of 25 mm (L/D=22) at an extrusion temperature of 300° C., followed by cooling with hot water of 85° C. The unstretched filament samples thus obtained were separately stretched 3.6 times as first-stage stretching in a wet heat atmosphere of 96° C. The thus-stretched filament samples were stretched 1.28 times as second-stage stretching in a dry heat atmosphere of 180° C.

Then, portions of the filament samples thus stretched were respectively heat-treated in a heated air bath under their corresponding conditions shown in Table 4 without conducting any ordinary heat treatment (the first heat treatment), thereby obtaining respective PPS fiber samples having a diameter of about 450 μm. The conditions of the heat treatment and the physical properties of the resultant filament samples are shown collectively in Table 4.

TABLE 4

| | Example 5 | | | | | Comparative Example 5 | | | | | | |
|---|---|---|---|---|---|---|---|---|---|---|---|---|
| | 5-1 | 5-2 | 5-3 | 5-4 | 5-5 | 5-1 | 5-2 | 5-3 | 5-4 | 5-5 | 5-6 | 5-7 |
| Melt viscosity (poise) | 5,060 | 5,060 | 5,060 | 3,280 | 1,090 | 5,060 | 3,280 | 1,090 | 5,060 | 5,060 | 5,060 | 3,280 |
| Heat-treating conditions: | | | | | | | | | | | | |
| Take-up ratio | 0.90:1 | 0.96:1 | 1.3:1 | 0.9:1 | 0.9:1 | — | — | — | 0.75:1 | 1.3:1 | 0.9:1 | 1.2:1 |
| Heat-treating temp (°C.) | 340 | 340 | 380 | 330 | 320 | — | — | — | 320 | 490 | 290 | 285 |
| Residence time (sec) | 3.0 | 3.5 | 0.7 | 3.0 | 3.2 | — | — | — | 4.3 | 2.5 | 32.0 | 33.0 |
| Physical properties: | | | | | | | | | | | | |
| Tensile strength (g/d) | 4.4 | 4.3 | 4.5 | 4.2 | 4.2 | 4.3 | 4.4 | 4.4 | 3.2 | | | |
| Tensile elongation (%) | 33 | 43 | 31 | 38 | 40 | 35 | 32 | 34 | 48 | | | |
| Knot tenacity (g/d) | 3.6 | 2.1 | 3.7 | 3.5 | 3.4 | 3.4 | 3.5 | 3.4 | 1.9 | | | |
| Knot elongation (%) | 17 | 26 | 15 | 20 | 23 | 21 | 18 | 19 | 21 | | | |
| Loop tenacity (g/d) | 4.8 | 3.8 | 4.9 | 4.6 | 4.5 | 5.3 | 5.1 | 5.1 | 3.3 | *1 | *2 | *2 |
| Loop elongation (%) | 14 | 21 | 13 | 15 | 16 | 15 | 14 | 14 | 22 | | | |
| Flexing abrasion resistance (times) | 4,386 | 4,688 | 3,630 | 3,854 | 3,912 | 1,208 | 1,096 | 925 | 4,643 | | | |
| Flexing fatigue resistance (times) | 171 | 168 | 154 | 157 | 161 | 89 | 78 | 71 | 186 | | | |

TABLE 4-continued

| | Example 5 | | | | | Comparative Example 5 | | | | | | |
|---|---|---|---|---|---|---|---|---|---|---|---|---|
| | 5-1 | 5-2 | 5-3 | 5-4 | 5-5 | 5-1 | 5-2 | 5-3 | 5-4 | 5-5 | 5-6 | 5-7 |
| Heat resistance (%) | 87 | 82 | 88 | 86 | 84 | 86 | 85 | 86 | 81 | | | |
| Chemical resistance (%) | 65 | 61 | 68 | 64 | 63 | 65 | 64 | 64 | 58 | | | |

*1: Broke during the second heat treatment.
*2: Fused off during the second heat treatment.

As is apparent from Table 1, the PPS fiber samples (Example 5, 5-1 through 5-5) obtained by heat-treating under the heat-treating conditions according to the present invention were all excellent in flex resistance, as demonstrated by the flexing abrasion resistance of at least 3,500 times and the flexing fatigue resistance of at least 150 times and moreover, good in strength properties such as tensile strength, knot tenacity and loop tenacity, heat resistance, and chemical resistance. On the contrary, the PPS fiber samples (Comparative Example 5, 5-1 through 5-3) obtained without conducting any heat treatments had extremely insufficient flex resistance.

Besides, the fiber sample (Comparative Example 5, 5-4) subjected to the heat treatment at a lower take-up ratio was improved in flex resistance, but its strength properties such as knot tenacity were reduced to a significant extend. In addition, when the heat-treating temperature was too high, or the residence time in the air bath was too long (Comparative Example 5, 5-5 or 5-6 and 5-7), the fiber samples broke or fused off during the heat treatment.

EXAMPLE 6 & COMPARATIVE EXAMPLE 6

A poly(phenylene sulfide) (product of Kureha Chemical Industry Co., Ltd.) having a melt viscosity (at 310° C. and a shear rate of 1,200 $sec^{-1}$) of 4,670 poises was melt-spun through a nozzle having a bore diameter of 3 mm by an extruder having a cylinder bore of 50 mm (L/D=28) at an extrusion temperature of 320° C., followed by cooling with hot water of 80° C.

The unstretched filament sample thus obtained was stretched 3.6 times in a wet heat atmosphere of 93° C. Portions of the thus-stretched filament sample were heat-treated at a take-up ratio of 1.3:1 (heat treatment under stretching) in dry heat atmospheres of 150° C., 200° C., 250° C., 280° C., 290° C., 310° C., 330° C. and 350° C., respectively, thereby obtaining respective PPS fiber samples (monofilaments) having a fineness of about 1,950 deniers. Their physical properties are shown in Table 5.

TABLE 5

| | Example 6 | | | | Comparative Example 6 | | | |
|---|---|---|---|---|---|---|---|---|
| | 6-1 | 6-2 | 6-3 | 6-4 | 6-1 | 6-2 | 6-3 | 6-4 |
| High-temperature stretching conditions: | | | | | | | | |
| Take-up ratio | 1.30:1 | 1.30:1 | 1.30:1 | 1.30:1 | 1.30:1 | 1.30:1 | 1.30:1 | 1.30:1 |
| Heat-treating temp (°C.) | 290 | 310 | 330 | 350 | 150 | 200 | 250 | 280 |
| Residence time (sec) | 5.6 | 5.6 | 5.6 | 5.6 | 5.6 | 5.6 | 5.6 | 5.6 |
| Physical properties: | | | | | | | | |
| Tensile strength (g/d) | 4.5 | 4.5 | 4.3 | 3.8 | 4.1 | 4.2 | 4.4 | 4.5 |
| Tensile elongation (%) | 32 | 32 | 33 | 37 | 34 | 34 | 33 | 33 |
| Knot tenacity (g/d) | 3.4 | 3.4 | 3.4 | 2.8 | 3.0 | 3.1 | 3.2 | 3.3 |
| Knot elongation (%) | 25 | 26 | 27 | 34 | 24 | 24 | 25 | 25 |
| Loop tenacity (g/d) | 4.9 | 4.8 | 4.7 | 4.0 | 4.8 | 4.9 | 4.8 | 4.9 |
| Loop elongation (%) | 15 | 15 | 16 | 18 | 19 | 19 | 18 | 17 |
| Flexing abrasion resistance (times) | 3,235 | 4,576 | 4,055 | 3,219 | 1,010 | 1,183 | 2,038 | 2,855 |
| Flexing fatigue resistance (times) | 167 | 171 | 161 | 154 | 85 | 96 | 121 | 142 |

EXAMPLE 7 & COMPARATIVE EXAMPLE 7

A poly(phenylene sulfide) (product of Kureha Chemical Industry Co., Ltd.) having a melt viscosity (at 310° C. and a shear rate of 1,200 $sec^{-1}$) of 3,500 poises was treated in substantially the same manner as in Example 6 & Comparative Example 6 to obtain respective PPS fiber samples having a fineness of about 1,950 deniers. Their physical properties are shown in Table 6.

TABLE 6

| | Example 7 | | | | Comparative Example 7 | | | |
|---|---|---|---|---|---|---|---|---|
| | 7-1 | 7-2 | 7-3 | 7-4 | 7-1 | 7-2 | 7-3 | 7-4 |
| High-temperature stretching conditions: | | | | | | | | |
| Take-up ratio | 1.30:1 | 1.30:1 | 1.30:1 | 1.30:1 | 1.30:1 | 1.30:1 | 1.30:1 | 1.30:1 |
| Heat-treating temp (°C.) | 290 | 310 | 330 | 350 | 150 | 200 | 250 | 280 |
| Residence time (sec) | 6.5 | 6.5 | 6.5 | 6.5 | 6.5 | 6.5 | 6.5 | 6.5 |
| Physical properties: | | | | | | | | |
| Tensile strength (g/d) | 4.5 | 4.6 | 4.4 | 4.0 | 4.1 | 4.3 | 4.4 | 4.4 |
| Tensile elongation (%) | 29 | 30 | 32 | 39 | 32 | 32 | 32 | 31 |
| Knot tenacity (g/d) | 3.2 | 3.2 | 3.2 | 2.6 | 2.9 | 3.0 | 3.1 | 3.2 |
| Knot elongation (%) | 24 | 25 | 26 | 37 | 24 | 24 | 24 | 24 |
| Loop tenacity (g/d) | 4.4 | 4.3 | 4.2 | 4.1 | 4.3 | 4.3 | 4.3 | 4.4 |
| Loop elongation (%) | 13 | 13 | 15 | 20 | 17 | 17 | 16 | 14 |
| Flexing abrasion | 3,156 | 3,981 | 3,677 | 3,022 | 736 | 821 | 1,373 | 2,354 |

TABLE 6-continued

| | Example 7 | | | | Comparative Example 7 | | | |
|---|---|---|---|---|---|---|---|---|
| | 7-1 | 7-2 | 7-3 | 7-4 | 7-1 | 7-2 | 7-3 | 7-4 |
| resistance (times) | | | | | | | | |
| Flexing fatigue resistance (times) | 158 | 170 | 162 | 151 | 72 | 88 | 111 | 122 |

As is apparent from Tables 5 and 6, even when the stretched filament sample stretched only at one stage in Step 2 was used, PPS fiber samples excellent in both strength properties and flex resistance could be obtained by conducting the heat treatment (Step 3) according to the present invention.

EXAMPLE 8 & COMPARATIVE EXAMPLE 8

A poly(phenylene sulfide) (product of Kureha Chemical Industry Co., Ltd.) having a melt viscosity (at 310° C. and a shear rate of 1,200 $sec^{-1}$) of 4,670 poises was melt-spun through a nozzle having a bore diameter of 3 mm by an extruder having a cylinder bore of 50 mm (L/D=28) at an extrusion temperature of 320° C., followed by cooling with hot water of 80° C.

The unstretched filament sample thus obtained was stretched 3.45 times in hot water of 98° C. Portions of the thus-stretched filament sample were respectively heat-treated at 290° C. and their corresponding take-up ratios shown in Table 7, thereby obtaining respective PPS fiber samples having a fineness of about 1,950 deniers. Their physical properties are shown in Table 7.

TABLE 7

| | Example 8 | | | | | Comp. Ex. 8 | |
|---|---|---|---|---|---|---|---|
| | 8-1 | 8-2 | 8-3 | 8-4 | 8-5 | 8-1 | 8-2 |
| High-temperature stretching conditions: | | | | | | | |
| Take-up ratio | 1.15:1 | 1.20:1 | 1.25:1 | 1.30:1 | 1.35:1 | 1.40:1 | 1.45:1 |
| Heat-treating temp (°C.) | 290 | 290 | 290 | 290 | 290 | 290 | 290 |
| Residence time (sec) | 5.6 | 5.6 | 5.6 | 5.6 | 5.6 | 5.6 | 5.6 |
| Physical properties: | | | | | | | |
| Tensile strength (g/d) | 3.6 | 3.8 | 4.1 | 4.5 | 4.7 | 4.5 | |
| Tensile elongation (%) | 47 | 41 | 35 | 32 | 29 | 25 | |
| Knot tenacity (g/d) | 2.6 | 3.1 | 3.4 | 3.4 | 3.1 | 2.7 | |
| Knot elongation (%) | 40 | 34 | 28 | 25 | 22 | 18 | |
| Loop tenacity (g/d) | 3.7 | 4.2 | 4.8 | 4.9 | 4.7 | 4.0 | *1 |
| Loop elongation (%) | 33 | 24 | 18 | 15 | 12 | 10 | |
| Flexing abrasion resistance (times) | 3,180 | 3,211 | 3,288 | 3,236 | 3,108 | 2,565 | |
| Flexing fatigue resistance (times) | 161 | 166 | 172 | 167 | 156 | 115 | |

*1: Broke during the heat treatment, and varied widely in physical properties.

As is apparent from Table 7, even when the stretched filament sample stretched only at one stage in Step 2 was used, PPS fiber samples excellent in both strength properties and flex resistance could be obtained by conducting the heat treatment (Step 3) according to the present invention.

We claim:

1. Poly(phenylene sulfide) fibers individually having the following physical and mechanical properties:

tensile strength being at least 4.0 g/d;

knot tenacity being at least 2.5 g/d;

loop tenacity being at least 4.0 g/d;

number of abrasion cycles until breaking in a flexing abrasion test being at least 3,500 times; and number of repeated flexings until breaking in a flexural fatigue test being at least 150 times.

2. The fibers according to claim 1, wherein the poly(phenylene sulfide) is selected from the group consisting of a homopolymer of p-phenylene sulfide, a homopolymer of m-phenylene sulfide, and a copolymer of p-phenylene sulfide and m-phenylene sulfide.

3. The fibers according to claim 1, wherein the p-phenylene sulfide is a substantially linear polymer comprising, as recurring units, p-phenylene sulfide units in a proportion of at least 50 wt. %.

4. The fibers according to claim 1, wherein the p-phenylene sulfide is a substantially linear polymer comprising, as recurring units, p-phenylene sulfide units in a proportion of at least 70 wt. %.

5. The fibers according to claim 1, wherein the p-phenylene sulfide is a substantially linear polymer comprising, as recurring units, p-phenylene sulfide units in a proportion of at least 90 wt. %.

6. The fiber according to claim 1, wherein the poly(phenylene sulfide) has a melt viscosity of at least 500 poises as measured at 310° C.

7. The fiber according to claim 1, wherein the poly(phenylene sulfide) has a melt viscosity of at least 800 poises as measured at 310° C. and a shear rate of 1,200 $sec^{-1}$.

* * * * *